US007208704B1

(12) United States Patent
Couts

(10) Patent No.: US 7,208,704 B1
(45) Date of Patent: Apr. 24, 2007

(54) HEATING DEVICE WITH THERMOSTAT SWITCH

(75) Inventor: Douglas L. Couts, Greenbrier, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/426,674

(22) Filed: Jun. 27, 2006

(51) Int. Cl.
*H05B 1/02* (2006.01)

(52) U.S. Cl. ..... 219/497; 219/491; 219/494; 219/511; 219/506; 324/417; 236/91 F

(58) Field of Classification Search ..... 219/490–494, 219/497, 501, 506, 507, 508, 510, 511, 512; 338/14, 25; 324/417; 236/91 R, 91 F
See application file for complete search history.

(56) References Cited

U.S. PATENT DOCUMENTS 3,301,980 A 1/1967 Geis
3,919,679 A 11/1975 Kingma
3,932,830 A 1/1976 Holtkamp
3,983,928 A * 10/1976 Barnes ..... 165/238
4,198,562 A * 4/1980 Mills et al. ..... 219/505
4,518,850 A * 5/1985 Grasso ..... 219/505
4,839,626 A 6/1989 Hollweck
4,968,963 A 11/1990 DeWitt et al.
6,057,529 A 5/2000 Kirby
6,093,014 A 7/2000 Anderson et al.
6,624,397 B2 * 9/2003 Tateishi ..... 219/508
2002/0158617 A1 10/2002 Garris, III

* cited by examiner

*Primary Examiner*—Mark Paschall
(74) *Attorney, Agent, or Firm*—Pearne & Gordon LLP

(57) ABSTRACT

A system for wiring a heating element in an electrical appliance to a conventional thermostat switch in a new manner and a new thermostat for supporting the new wiring system. The new wiring system avoids switching the full heating element current for both hot power leads of a split-phase power system to reduce the amount of wiring needed to wire the thermostat switch to a heating element and a pilot lamp showing that current is being provided to the heating element.

23 Claims, 8 Drawing Sheets

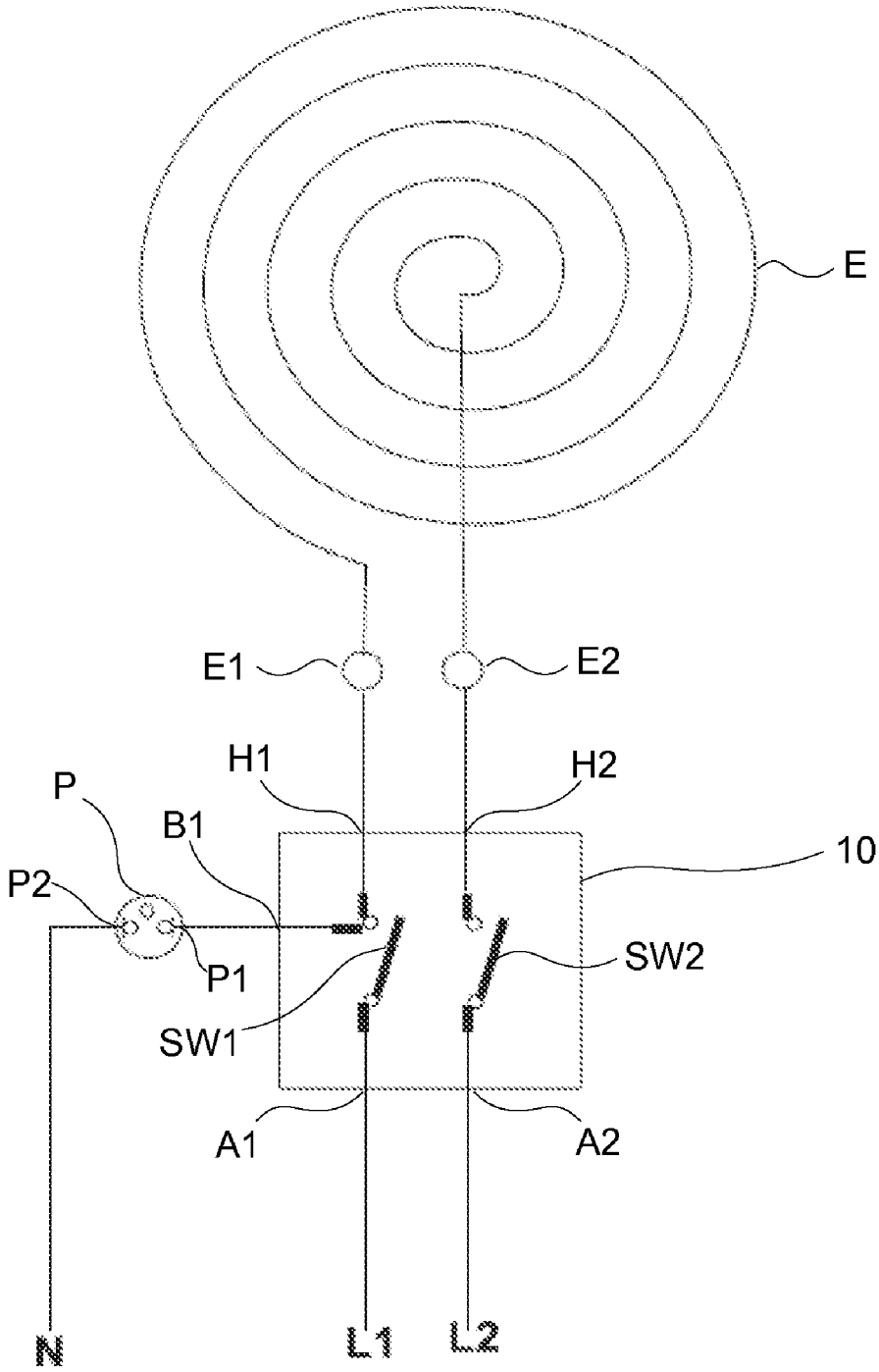
Figure 1
(Conventional)

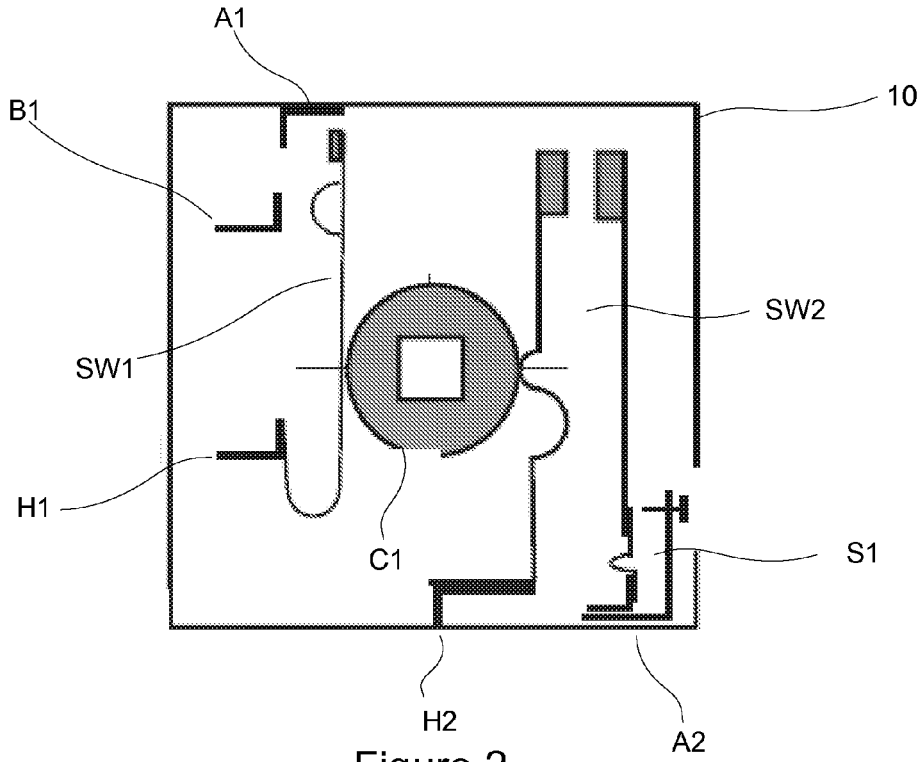
Figure 2
(Conventional)

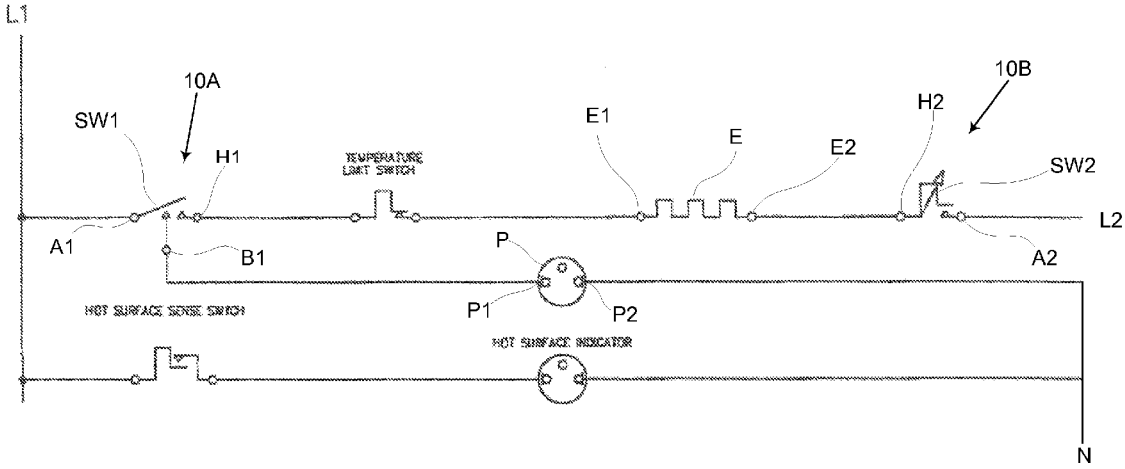
Figure 3
(Conventional)

HEATING DEVICE WITH THERMOSTAT SWITCH

BACKGROUND OF THE INVENTION

This application relates to a system for wiring a heating element in an electrical appliance to a thermostat switch in a new manner and a new thermostat switch for supporting the new wiring system.

Residential and light commercial cooking appliances often utilize 240 volt split-phase systems, which are a 3-wire, single-phase, mid-point neutral 240 volt power system that is typically provided for residential and light industrial use in the United States. Such a system has two live hot conductors (terminals), and a neutral conductor (terminal). Each live conductor provides a voltage of about 120VAC with respect to the neutral conductor (which is typically grounded), whereas the hot terminals provides a voltage of about 240VAC with respect to each other. Of course, the actual voltages might vary from utility to utility and place to place, such as between 200VAC and 260VAC (100VAC to 130VAC).

Heating appliances, and in particular electric stoves, will typically utilize the 240VAC split-phase power in order to reduce the current draw on the home wiring system, and thus avoid the use of overly thick conductors. Thus, such appliances must be connected to both hot terminals of the power supply, utilizing the split-phase system. Modern appliances also tend to include 120VAC components as well, such a light fixtures or control systems, and thus such appliances will also be connected to the neutral terminal of the power supply as well. In such a case, only one of the hot terminals, along with the neutral terminal, need be utilized to provide the 120VAC power. Furthermore, the neutral conductor is often utilized for safety reasons as well.

Conventionally, thermostats having connections to both hot terminals of the power supply have been utilized in such heating appliances. Often, an "infinite switch" 10 such as the one shown in a simplified schematic in FIG. 2 is utilized as a thermostat switch in the manner shown in the wiring diagram of FIG. 1, or the additional wiring as shown in FIG. 3 may be used. The connections to the power supply and the heating element, and SW1 and SW2, must all carry the maximum heating element current, and thus must be sized for substantial current loads. However, such wiring is wasteful, complicated, and utilizes much more wire than might otherwise be necessary for some appliances. Furthermore, the infinite switch 10 is more complicated than it needs to be.

Desired is a means of reducing this thermostat complexity, and/or reducing the amount of wasteful and/or complicated wiring.

SUMMARY OF THE INVENTION

Provided is a system for wiring a heating element in an electrical appliance to a thermostat (infinite) switch in a new manner and/or a new thermostat switch for supporting the new wiring system.

This can be provided by a plurality of embodiments of the invention, including, but not limited to, a circuit for controlling an electrical heating element in an appliance. The circuit comprising: a heating element including a first element terminal and a second element terminal; a pilot light including a first pilot terminal and a second pilot terminal; and a thermostat switch.

The thermostat switch includes: an element contact electrically connected to the second element terminal; at least one power contact, a pilot contact connected to a first pilot terminal, a sensing device for detecting a temperature of the heating element, an element switch, a pilot switch; a control device, and a sensing device.

The element switch is for intermittently electrically connecting and disconnecting one of the at least one power contact to the element contact.

The control device is adapted for receiving a temperature setting of a desired temperature of the electrical heating element, wherein the control device controls the element switch based on a temperature detected by the sensing device and also based on the temperature setting, wherein the control device is also adapted for preventing the element switch from making electrical contact between the one of the at least one power contact and the element contact when the control device is set in an off position.

The pilot switch is for electrically connecting the one or an additional one of the at least one power contact to the pilot contact when the control device is not in an off position and disconnecting the one or the additional one of the at least one power contact from the pilot contact when the control device is in the off position.

The system also includes a split-phase power supply including: a first voltage source electrically connected to the first element terminal bypassing the thermostat switch, a second voltage source electrically connected to the one of the at least one power contact, and a neutral terminal electrically connected to the second pilot terminal.

Also provided is a circuit for controlling an electrical heating element in an appliance, with the circuit comprising: a heating element including a first element terminal and a second element terminal; a pilot light including a first pilot terminal and a second pilot terminal; and a thermostat switch.

The thermostat switch includes: a first element contact electrically connected to the second element terminal; a second element contact not electrically connected to the first element terminal; a first power contact, a second power contact; a pilot contact connected to a first pilot terminal, a sensing device for detecting a temperature of the heating element; an element switch for intermittently electrically connecting and disconnecting the second power contact to the element contact; a control device, and a pilot switch.

The control device is adapted for receiving a temperature setting of a desired temperature of the electrical heating element, wherein the control device controls the element switch based on a temperature detected by the sensing device and also based on the temperature setting, wherein the control device is also adapted for preventing the element switch from making electrical contact between the second power contact and the element contact when the control device is set in an off position.

The pilot switch is for electrically connecting the first power contact to the pilot contact when the control device is not in an off position and disconnecting the first power contact from the pilot contact when the control device is in the off position.

A split-phase power supply is utilized for the system, with the supply including: a first voltage source electrically connected to the first element terminal utilizing a wire sized to carry a current to power the heating element, wherein the first voltage source is also connected to the second power contact using a wire sized for a current substantially less than the current to power the heating element, a second voltage source electrically connected to the first power contact, and a neutral terminal electrically connected to the second pilot terminal.

Still further provided is a method of using a thermostat switch to control the temperature of a heating element, the thermostat switch comprising: a first element contact; at least one power contact, a pilot contact, a sensing device for detecting a temperature of the heating element, an element switch for intermittently electrically connecting and disconnecting one of the at least one power contact to the element contact; a control device adapted for receiving a temperature setting of a desired temperature of the electrical heating element, wherein the control device controls the element switch based on a temperature detected by the sensing device and also based on the temperature setting, wherein the control device is also adapted for preventing the element switch from making electrical contact between the one of the at least one power contact and the element contact when the control device is set in an off position, and a pilot switch for electrically connecting the one or an additional one of the at least one power contact to the pilot contact when the control device is not in an off position and disconnecting the one or the additional one of the at least one power contact from the pilot contact when the control device is in the off position;

The method comprises the steps of:

1) electrically connecting the first element contact to a first element terminal of the heating element;
2) electrically connecting a second element terminal of the heating element to a first voltage source bypassing the thermostat switch;
3) electrically connecting the one of the at least one power contact to a second voltage source;
4) electrically connecting the pilot contact to a first terminal of a pilot light; and
5) electrically connecting a second terminal of the pilot light to a common neutral terminal of the first and second voltage supplies.

Also provided are additional embodiments of the invention, some, but not all of which, are described hereinbelow in more detail.

BRIEF DESCRIPTION OF THE DRAWINGS

The foregoing and other features and advantages of the present invention will become apparent to those skilled in the art to which the present invention relates upon reading the following description with reference to the accompanying drawings, in which:

FIG. 1 shows a simplified conventional thermostat and heating element wiring scheme;

FIG. 2 shows a conventional thermostat for supporting a heating device;

FIG. 3 shows another embodiment of the conventional thermostat and heating element wiring scheme;

DETAILED DESCRIPTION

Figure 6:
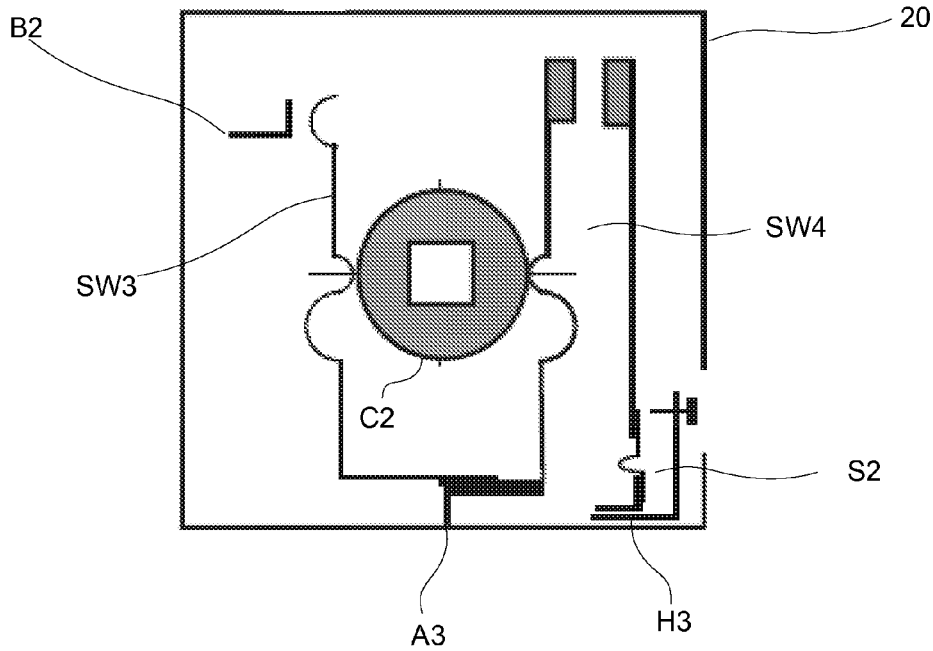
FIG. 6 shows an embodiment of a infinite switch designed to support the new wiring scheme.

FIG. 1 is a simplified diagram showing one conventional means of wiring a conventional infinite switch 10 used as a thermostat switch into a heating element circuit, including a heating element E with a first element terminal E1 and a second element terminal E2. The conventional infinite switch 10, shown in more detail in the simplified schematic of FIG. 2, has a first element contact H1 for electrically connecting to the first element terminal E1, and a second element contact H2 for electrically connecting to the second element terminal E2. The infinite switch 10 connects to a split-phase power supply via first supply contact A1 which is electrically connected to the first hot voltage supply L1 (at about 120VAC above neutral), and second supply contact A2 which is electrically connected to the second hot voltage supply L2 (also at about 120VAC above neutral, but at about 240VAC with respect to L1).

The infinite switch 10 also has a pilot contact B1 for electrically connecting to a pilot lamp P, and a first switch SW1 for electrically connecting a first pilot terminal P1 of the pilot lamp P to the first hot voltage supply L1, and also for electrically connecting the first element terminal E1 to the supply L1. Note that the second pilot terminal P2 is electrically connected to the split-phase power supply neutral terminal. A second switch SW2 intermittently connects the second element terminal E2 to the second hot voltage supply L2. The infinite switch 10 also has a sensing device S1 for detecting the temperature of the element E, either directly by utilizing the heat put off by the element E, or indirectly by measuring the current flow through the element E in some manner (such as by the combination a heater and a bimetal device, for example). A control device C1 operates with the sensing device S1 for providing temperature control, and typically also to turn the element E off (i.e., disconnect the element from the voltage source). First switch SW1 works in conjunction with second switch SW2, the sensing device S1, and the control device C1 to ensure the following:

1) The temperature of the heating element E is controlled by a setting of the control device C1;
2) The first pilot terminal P1 and the first element terminal are both electrically connected to the first hot terminal L1 of the split-phase power supply by the first switch SW1 whenever the control device C1 is set to provide a heating temperature for the heating element E (i.e., the control device C1 (or some other on/off switch) is not set to an off position);
3) The sensing device S1 works in conjunction with the control device C1 and the second switch SW2 to intermittently connect the second element terminal E2 to the second hot terminal L2 to maintain a desired temperature of the heating element E by controlling the current flowing through the heating element E (such as by pulse-width-modulating the current, for example); and
4) Both SW1 and SW2 are sized to at least carry the maximum current capability of the heating element (e.g., for maximum heating), as are the conductors connecting the thermostat switch to the first and second hot terminals L1 and L2.

The manner of operation of such a thermostat switch is known in the art, and need not be specified here in any detail.

For example, similar such thermostat switches are discussed in U.S. patent application Ser. No. 10/058,350 and U.S. Pat. Nos. 6,111,231 and 6,093,014, incorporated herein by reference. Additional types of thermostat switches can also be utilized.

FIG. 3 is another wiring diagram showing the infinite switch 10 installed in a consumer cooking device, such as a stovetop. The thermostat 10 is shown schematically represented by two portions, 10A utilizing the first switch SW1, and 10B utilizing the second switch SW2.

Figure 4:
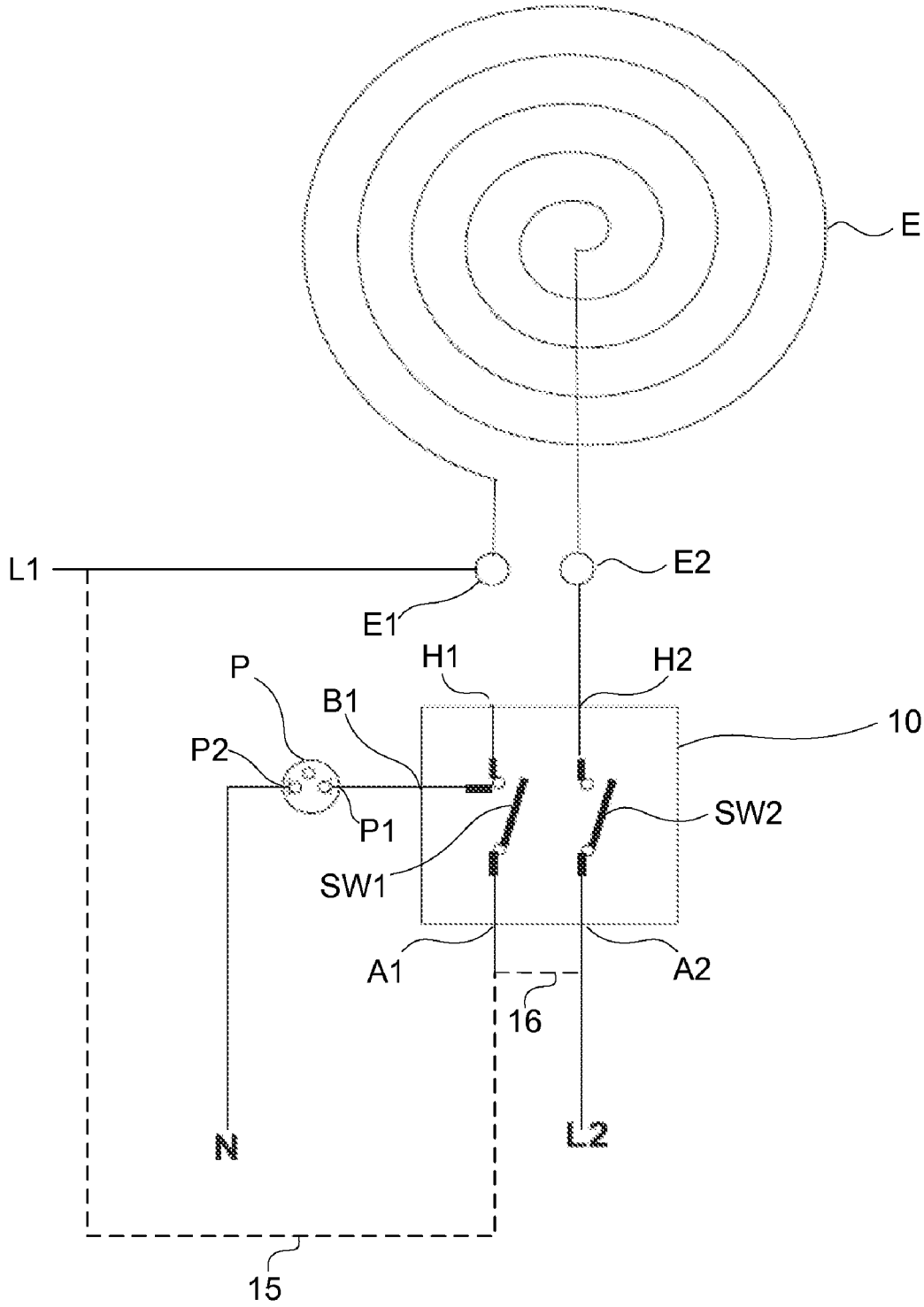
FIG. 4 is a simplified diagram showing possible modifications of the conventional thermostat and heating element wired in a new manner.

The conventional infinite switch 10 can be used in an improved wiring harness wired in a new manner to save a substantial amount of wire length. FIG. 4 shows a simplified diagram showing two different options that can be used for an improved wiring scheme. Either (1) a lower gauge wire 15 can be used to connect the first supply contact A1 to the first hot supply L1 to power the pilot light, or (2) a jumper 16 can connect the first supply contact A1 to the second supply contact A2 to utilize the second hot supply L2 to power the pilot light. The first option is used where, because of the arrangement and/or installation of the switch, the jumper 16 is not feasible. Note that in no case should both the low gauge wire 15 and jumper 16 be used in the same wiring scheme, as this would short out the power supplies L1 and L2.

Figure 5A:
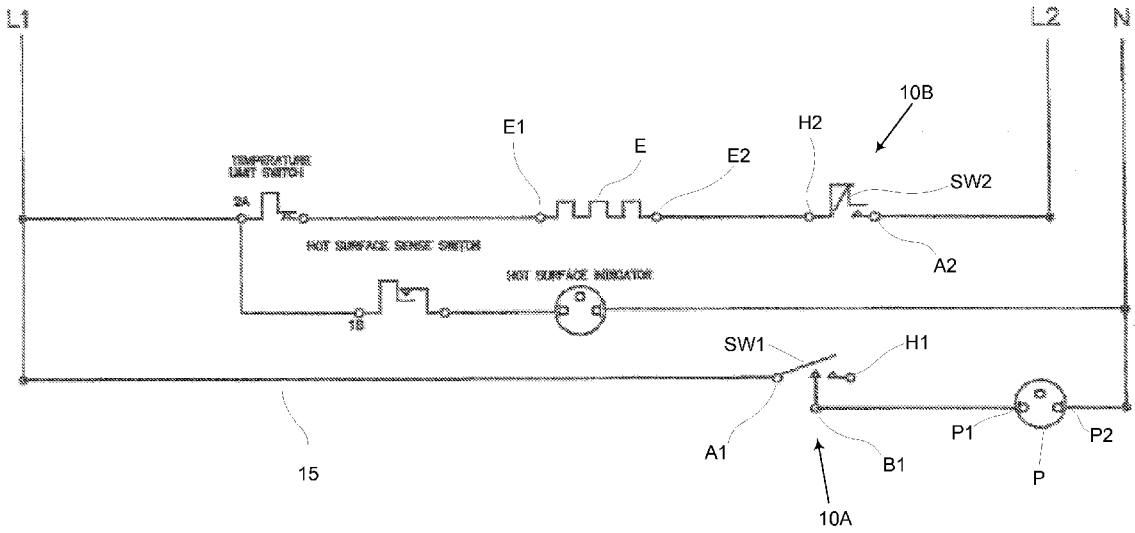
FIGS. 5A and 5B are diagrams showing additional embodiments of the conventional thermostat and heating element each wired a in new manner.

FIG. 5A shows another embodiment of how the conventional infinite switch 10 can be utilized in a similar manner as discussed in the first option for FIG. 3. This figure illustrates a wiring harness change to eliminate a wiring harness between terminal H1 on the surface unit switch and terminal 2A on the element shown in the conventional harness in FIG. 3.

The wire 15 electrically connecting L1 to the first switch SW1 can be reduced in wire gauge size from 14 gauge to 20 gauge because it will only serve the pilot light circuit.

An additional jumper is used to connect terminal 2A of the temperature limit switch (which, in an example embodiment, is part of the element E) to terminal 1B of the Hot Surface Sense Switch. In the example embodiment, this will add approximately 24 inches of wire to this portion of the harness. The Hot Surface Indicator light will come on whenever the glass surface temperature becomes sufficiently hot to close the contacts in the Hot Surface Sense Switch. This switch is typically physically mounted on the heating element E and can be an integral part of the element itself.

The Hot Surface Sense Switch is a type of safety switch whose primary function is to prevent damage to the glass cooktop due to overheating condition. If the surface temperature exceeds the specified level this switch will "open" and interrupt the L1 power feed to the element thereby turning it off until the surface cools sufficiently to allow the switch contacts to close.

The resulting change in the wire harness of the example embodiment will eliminate approximately 141.5 inches of wire as well as four terminal ends that plug onto H1 at the switch in the example embodiment. After deducting additional length from the L1 harness to the element E, the net savings will be approximately 117.5 inches of 16 gauge type 33 wire for a four unit surface stove. For example, in the typical configuration there is already an existing L1 wire on the body of the surface heating element that feeds the "Hot Surface Indicator" circuit. By increasing the gauge of this wire slightly and using it to also provide L1 power to the element directly one can eliminate the wire and terminal ends from the switch SW1 to the element E.

Figure 5B:
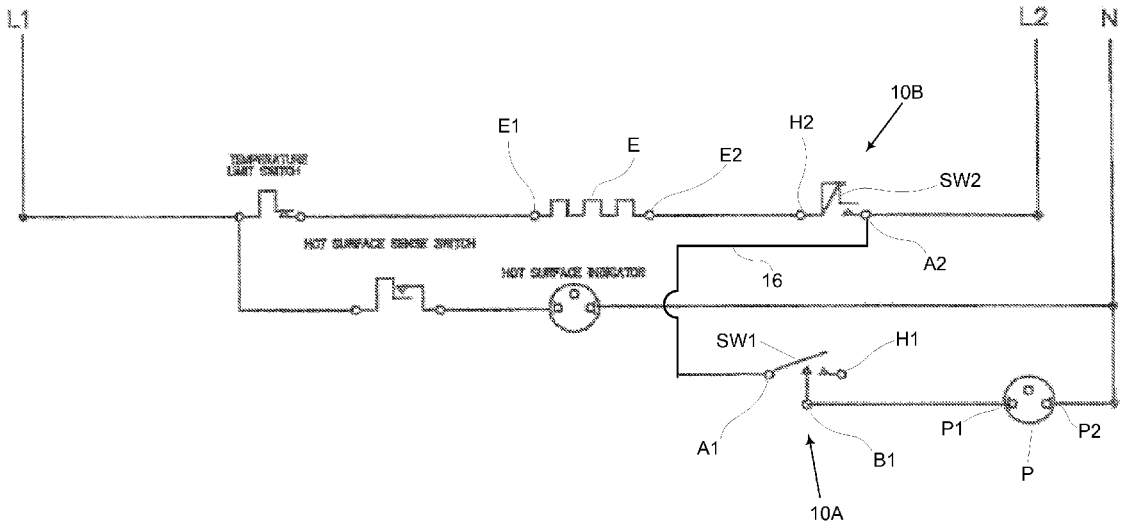

FIG. 5B shows another embodiment of how the conventional infinite switch 10 can be utilized in a similar manner as discussed in the second option for FIG. 3. The first element terminal E1 can be electrically connected to the first hot supply terminal L1 in a manner shown in the diagrams, rather than being switched by the first switch SW1 of the infinite switch 10. Thus, the first element contact H1 need not be utilized in this new wiring scheme. A jumper 16 is used to connect the first supply contact A1 of the conventional infinite switch 10 to the second supply contact A2, which is, as in the conventional wiring, electrically connected to the second hot supply terminal L2. Thus, both supply contacts A1 and A2 are electrically connected to the same voltage supply source. Finally, the second element contact H2 and pilot contact B1 are electrically connected to the infinite switch 10 as in the conventional wiring scheme, except that the pilot contact P1 is now electrically connected to the second hot supply terminal L2 via first switch SW1 (rather than connecting to the other voltage supply L1, as in the conventional scheme). Accordingly, in this usage, the first switch SW1 of the infinite switch no longer has to carry the element current, and need carry only the pilot current.

Such an improved wiring scheme of FIG. 5B allows the elimination of wires that previously connected the first element contact H1 with the first element terminal E1, as well as an elimination of the wiring that connected the first hot supply L1 with the first supply contact A1 of the infinite switch 10. This option also provides a substantial savings in wire.

Such new wiring schemes as described above might also be utilized by conventional thermostats (infinite switches) that have different configurations than that shown in FIG. 2.

Figure 7:
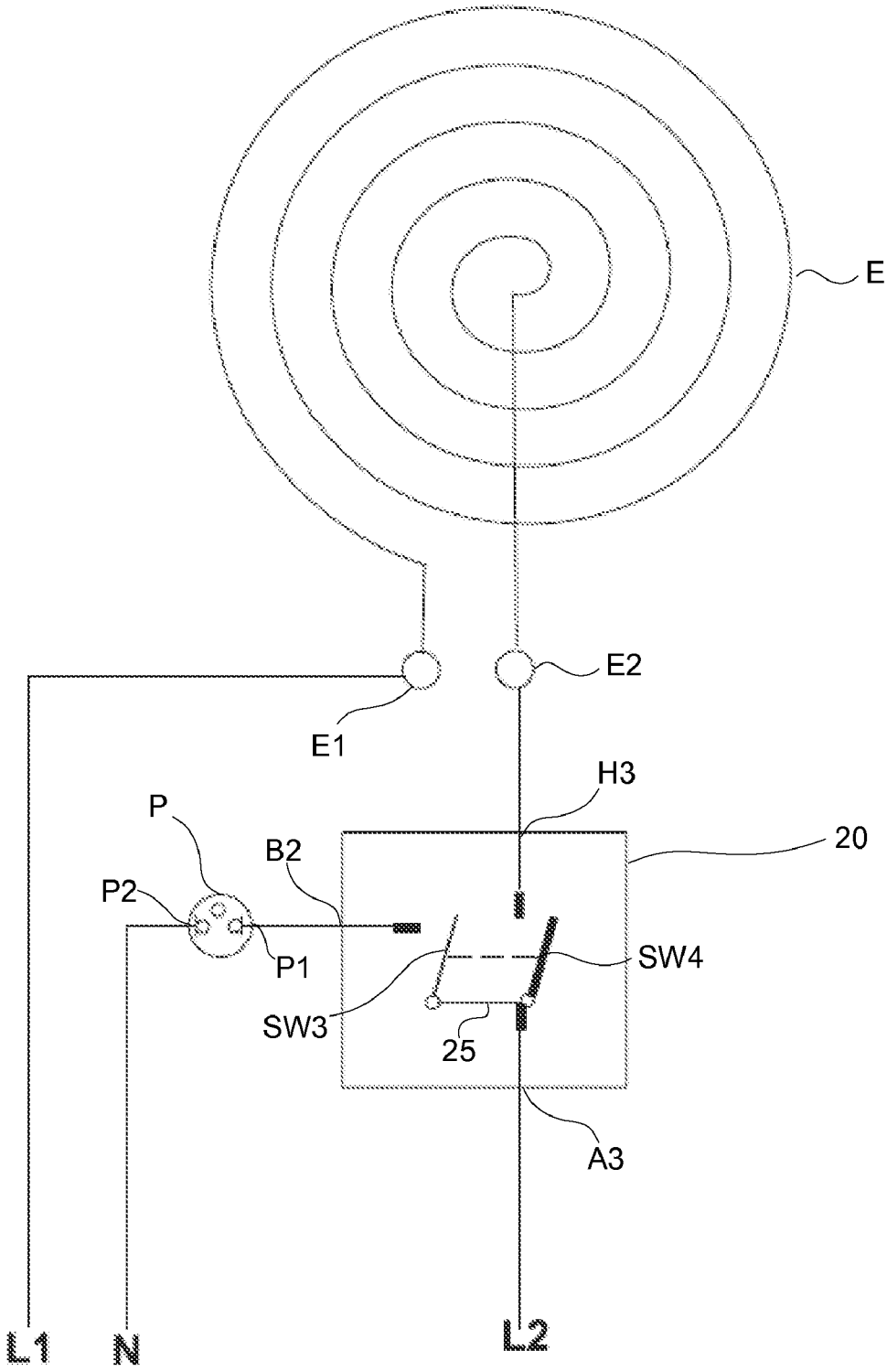
FIG. 7 is a diagram showing an embodiment of the infinite switch of FIG. 6 and a heating element wired in the new manner.
Figure 8:
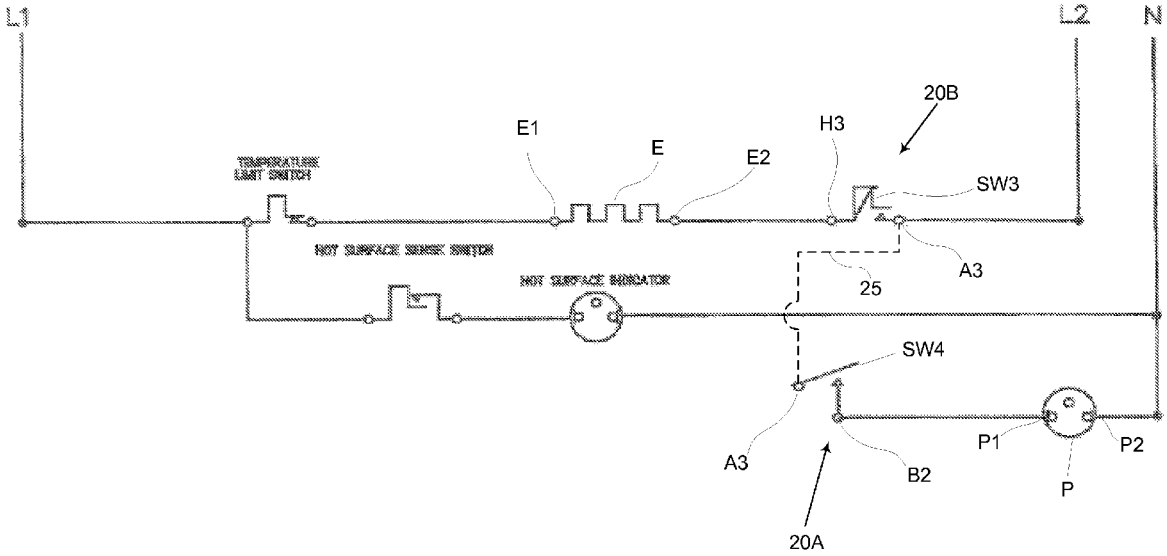
FIG. 8 is a diagram showing another embodiment of the infinite switch of FIG. 6 and a heating element wired in the new manner.

Because the infinite switch 10 utilized in the new wiring schemes of FIGS. 4, 5A, and 5B no longer require two external contacts (i.e., A1 and H1), and because the first switch SW1 no longer need carry the large maximum heating element current in the new scheme, an improved infinite switch design can be provided to support the new wiring scheme. FIG. 6 shows such an improved infinite switch 20, while FIGS. 7 and 8 show such a switch in diagrams analogous to those in FIGS. 4 and 5. Note, however, that the jumper 16 electrically connecting A1 and A2 in FIG. 5B reflects an externally wired connection for electrically connecting A1 and A2 together for infinite switch 10 (and line 15 in FIG. 5A is an external wire as well), whereas in FIG. 8, the broken line 25 electrically connecting A3 of 20A to A3 of 20B (or the solid line 25 shown in FIG. 7) merely represents that these are the same connector, or represent an internal jumper, in the new infinite switch 20.

In one embodiment, the improved infinite switch 20 eliminates at least two external contacts. Thus, this infinite switch 20 only requires one element connector H3 for electrically connecting to the second element terminal E2. Only one hot power connector A3 is provided for electrically connecting to the second hot supply terminal L2. The hot power connector A3 is further electrically connected, typically internally, to both the first switch SW3 and the second switch SW4, and the current carrying capacity of the first switch SW3 can be reduced compared to the second switch SW4 (and the conventional infinite switch 10 switches SW1 and SW2). Only the second switch SW4 need carry the full maximum heating element current, whereas the fist switch SW3 need only carry a current sufficient to power the pilot lamp P. A pilot contact B3 is provided such that the first switch SW3 connects the pilot contact B3 to the second hot power terminal L2 in a manner similar to that discussed for the conventional design (except it is connected to the other voltage source), but now the first switch SW3 is no longer utilized to connect the heating element E to the any hot terminal.

The improved infinite switch 20 has a control device C2 and a sensing device S2 that can be similar in operation and/or design to the respective C1 and S1 of the conventional design. The infinite switch 20, however operates in the following unique manner:

1) The temperature of the heating element E is controlled by a setting of the control device C2;
2) The first pilot terminal P1 of the pilot light P is electrically connected to the second hot supply terminal L2 of the split-phase power supply by the first switch SW3 whenever the control device C2 is set to provide a current to the heating element E (i.e., the thermostat is not set to an off position); and
3) The sensing device S2 works in conjunction with the control device C2 and the second switch SW4 to intermittently connect the second terminal E2 of the heating element E to the second hot terminal L2 to maintain a desired temperature of the heating element E in a manner similar to the conventional thermostat operation (except that the heating element current need not flow through the first switch SW3).

Accordingly, the improved infinite switch does not require any contact for electrically connecting to the first hot supply terminal of the split-phase power supply, and it requires only a single element contact to connect to the heating element (and thus two contacts are eliminated from the infinite switch 20). Furthermore, the pilot light is now powered off the second hot terminal rather than the first hot terminal. This allows the first switch SW3 of the infinite switch 20 to carry a lower current, and thus to save on material costs in its design.

A three-terminal thermostat switch that is similar to that described above, except that it is not designed to utilize a split-phase system, is found in U.S. Pat. No. 4,968,963, incorporated herein by reference.

These improved wiring schemes and thermostat switches are particularly useful for Smooth/Glass top consumer ranges, where the power terminals of the heating elements are not exposed to the consumer. Thermostat switches that sense the heating element temperature using various different means can be utilized, such as switches that indirectly sense temperature (via direct or indirect current measurement), or even direct temperature measurement, could be used. The examples shown herein are for illustrative purposes.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. A circuit for controlling an electrical heating element in an appliance, said circuit comprising:

a heating element including a first element terminal and a second element terminal;

a pilot light including a first pilot terminal and a second pilot terminal;

a thermostat switch including:

an element contact electrically connected to said second element terminal;

at least one power contact, a pilot contact connected to a first pilot terminal, a sensing device for detecting a temperature of said heating element, an element switch for intermittently electrically connecting and disconnecting one of said at least one power contact to said element contact;

a control device adapted for receiving a temperature setting of a desired temperature of the electrical heating element, wherein said control device controls said element switch based on a temperature detected by said sensing device and also based on the temperature setting, wherein said control device is also adapted for preventing said element switch from making electrical contact between said one of said at least one power contact and said element contact when said control device is set in an off position, and a pilot switch for electrically connecting said one or an additional one of said at least one power contact to said pilot contact when said control device is not in an off position and disconnecting said one or said additional one of said at least one power contact from said pilot contact when said control device is in the off position;

and a split-phase power supply including:

a first voltage source electrically connected to said first element terminal bypassing said thermostat switch, a second voltage source electrically connected to said one of said at least one power contact, and a neutral terminal electrically connected to said second pilot terminal.

2. The system of claim 1, wherein said thermostat switch further includes:

an additional power contact electrically connected to said one of said at least one power contact; and an additional element contact that is not electrically connected to said first element terminal, wherein said pilot switch electrically connects said pilot contact to said power contact via said additional power contact.

3. The system of claim 1, wherein at least one additional switch is provided between said first voltage source and said first element terminal.

4. The system of claim 1, wherein said pilot switch is sized to carry substantially the same current as said element switch.

5. The system of claim 4, wherein said thermostat switch further includes:

the additional power contact electrically connected to said first voltage source utilizing a conductor that is sized to carry a substantially lower current than a maximum current carried by said heating element; and an additional element contact that is not electrically connected to said first element terminal, wherein said pilot switch electrically connects said pilot contact to said second power contact.

6. The system of claim 5, wherein at least one additional switch is provided between said first voltage source and said first element terminal.

7. The system of claim 1, wherein at least one additional switch is provided between said first voltage source and said first element terminal.

8. The system of claim 1, wherein said pilot switch is sized to carry a substantially lower current than said element switch.

9. The system of claim 8, wherein the voltage between said first voltage source and said second voltage source is about double the voltage between either of said first voltage source and said second voltage source and said neutral terminal.

10. The system of claim 1, wherein said pilot switch is sized to carry the substantially same current as said element switch.

11. The system of claim 1, wherein the voltage between said first voltage source and said second voltage source is about double the voltage between either of said first voltage source and said second voltage source and said neutral terminal.

12. The system of claim 1, wherein said electrical heating element is a stovetop element, and wherein said thermostat switch is a user temperature control for said stovetop element.

13. A circuit for controlling an electrical heating element in an appliance, said circuit comprising:

a heating element including a first element terminal and a second element terminal;

a pilot light including a first pilot terminal and a second pilot terminal;

a thermostat switch including:

a first element contact electrically connected to said second element terminal;

a second element contact not electrically connected to said first element terminal;

a first power contact, a second power contact;

a pilot contact connected to a first pilot terminal, a sensing device for detecting a temperature of said heating element, an element switch for intermittently electrically connecting and disconnecting said second power contact to said element contact;

a control device adapted for receiving a temperature setting of a desired temperature of the electrical heating element, wherein said control device controls said element switch based on a temperature detected by said sensing device and also based on the temperature setting, wherein said control device is also adapted for preventing said element switch from making electrical contact between said second power contact and said element contact when said control device is set in an off position, and a pilot switch for electrically connecting said first power contact to said pilot contact when said control device is not in an off position and disconnecting said first power contact from said pilot contact when said control device is in the off position;

and a split-phase power supply including:

a first voltage source electrically connected to said first element terminal utilizing a wire sized to carry a current to power the heating element, wherein said first voltage source is also connected to said first power contact using a wire sized for a current substantially less than the current to power the heating element, a second voltage source electrically connected to said second power contact, and a neutral terminal electrically connected to said second pilot terminal.

14. The system of claim 13, wherein said pilot switch is sized to carry a current equal to or greater than said current to power the heating element.

15. The system of claim 13, wherein the voltage between said first voltage source and said second voltage source is about double the voltage between either of said first voltage source and said second voltage source and said neutral terminal.

16. The system of claim 13, wherein said electrical heating element is a stovetop element, and wherein said thermostat is a user temperature control for said stovetop element.

17. A method of using a thermostat switch to control the temperature of a heating element, said thermostat switch comprising:

a first element contact;

at least one power contact, a pilot contact, a sensing device for detecting a temperature of the heating element, an element switch for intermittently electrically connecting and disconnecting one of said at least one power contact to said element contact;

a control device adapted for receiving a temperature setting of a desired temperature of the electrical heating element, wherein said control device controls said element switch based on a temperature detected by said sensing device and also based on the temperature setting, wherein said control device is also adapted for preventing said element switch from making electrical contact between said one of said at least one power contact and said element contact when said control device is set in an off position, and a pilot switch for electrically connecting said one or an additional one of said at least one power contact to said pilot contact when said control device is not in an off position and disconnecting said one or said additional one of said at least one power contact from said pilot contact when said control device is in the off position;

said method comprising the steps of:

electrically connecting said first element contact to a first element terminal of said heating element;

electrically connecting a second element terminal of said heating element to a first voltage source bypassing said thermostat switch;

electrically connecting said one of said at least one power contact to a second voltage source;

electrically connecting said pilot contact to a first terminal of a pilot light; and electrically connecting a second terminal of the pilot light to a common neutral terminal of the first and second voltage supplies.

18. The method of claim 17, wherein said thermostat switch further comprises a second element contact and said additional power contact, said method further comprising the steps of:

electrically connecting the additional power contact to the first voltage source using a conductor sized for substantially less than a maximum current to be supplied to the heating element; and not electrically connecting the second element contact to the heating element, wherein said step of electrically connecting said one of said at least one power contact to a second voltage source is done using a conductor sized to carry a current greater than or equal to the maximum current to be supplied to the heating element.

19. The method of claim 18, wherein at least one additional switch is provided between the first voltage source and the first element terminal.

20. The method of claim 19, wherein said pilot switch is sized to carry substantially the same current as said element switch.

21. The method of claim 17, wherein said pilot switch is sized to carry a substantially lower current than said element switch.

22. The method of claim 17, wherein said pilot switch is sized to carry substantially the same current as said element switch.

23. The method of claim 17, wherein at least one additional switch is provided between the first voltage source and the first element terminal.

* * * * *